US007330066B2

(12) United States Patent
Huang

(10) Patent No.: US 7,330,066 B2
(45) Date of Patent: Feb. 12, 2008

(54) REFERENCE VOLTAGE GENERATION CIRCUIT THAT GENERATES GAMMA VOLTAGES FOR LIQUID CRYSTAL DISPLAYS

(75) Inventor: Jiunn-Yau Huang, Tainan County (TW)

(73) Assignee: Himax Technologies Limited, Fonghua Village, Sinshih Township, Tainan County (TW)

( * ) Notice: Subject to any disclaimer, the term of this patent is extended or adjusted under 35 U.S.C. 154(b) by 51 days.

(21) Appl. No.: 10/908,772

(22) Filed: May 25, 2005

(65) Prior Publication Data

US 2006/0267672 A1 Nov. 30, 2006

(51) Int. Cl.
*G05F 1/10* (2006.01)

(52) U.S. Cl. ..... 327/540; 341/153

(58) Field of Classification Search ..... 327/530, 327/538, 540, 541, 542, 543; 341/153, 154
See application file for complete search history.

(56) References Cited

U.S. PATENT DOCUMENTS 4,146,882 A * 3/1979 Hoff et al. ..... 341/138
4,667,178 A * 5/1987 Ryu ..... 341/136
5,640,174 A * 6/1997 Kamei et al. ..... 345/89
5,877,717 A * 3/1999 Tu et al. ..... 341/150
6,181,263 B1 * 1/2001 Malik et al. ..... 341/118
6,304,255 B1 * 10/2001 Suzuki et al. ..... 345/211
6,437,716 B2 * 8/2002 Nakao ..... 341/118
6,518,898 B1 * 2/2003 Choksi ..... 341/118
6,518,946 B2 * 2/2003 Ode et al. ..... 345/98
6,535,152 B2 * 3/2003 Lee ..... 341/118
6,731,259 B2 5/2004 Yer et al. ..... 345/89
6,778,161 B2 * 8/2004 Chen et al. ..... 345/89
6,856,265 B2 * 2/2005 Kuo et al. ..... 341/118
7,006,065 B1 * 2/2006 Sugawara et al. ..... 345/89
2003/0151577 A1 8/2003 Morita ..... 345/89
2003/0182609 A1 * 9/2003 Agrawal et al. ..... 714/724
2004/0021627 A1 * 2/2004 Maki ..... 345/89

* cited by examiner

*Primary Examiner*—Kenneth B. Wells
*Assistant Examiner*—Thomas J. Hiltunen
(74) *Attorney, Agent, or Firm*—Winston Hsu

(57) ABSTRACT

A gamma voltage generation circuit coupled to a digital-to-analog converter and provides the digital-to-analog converter with reference voltages by voltage division through resistor circuits. A variable voltage source can be modulated and charge-sharing switches can be included to save power. The reference voltage generation circuit can adopt output buffers that further improve the driving capability of the reference voltage generation circuit.

19 Claims, 9 Drawing Sheets

REFERENCE VOLTAGE GENERATION CIRCUIT THAT GENERATES GAMMA VOLTAGES FOR LIQUID CRYSTAL DISPLAYS

BACKGROUND OF INVENTION

1. Field of the Invention

The present invention relates to a reference voltage generation circuit, and more particularly, to a reference voltage generation circuit that generates gamma voltages for liquid crystal displays.

2. Description of the Prior Art

With the widespread of cellular phones and personal data assistants (PDAs), different types of small-sized displays are required for such portable electronic devices. Among them, liquid crystal displays (LCDs) are the top choices for such small-sized devices due to low power consumption and high quality image display.

Generally, an image signal for displaying an image is subjected to gamma correction in accordance with a display characteristic of a display device. Gamma is a measure of contrast in an image and the way the brightness of an image is interpreted by certain hardware. In LCD devices, the gamma correction is carried out by a reference voltage generation circuit, namely the gamma correction circuit, in which multi-valued voltages are created in accordance to the transmittance of a pixel based on gray scale data for carrying out gray scale display. The gamma correction circuit generally comprises a resistance string having a plurality of serially arranged resistors and the voltages across two opposed ends of respective resistor circuits constituting the ladder resistor are outputted as multi-valued reference voltages in accordance with gray scale value.

FIG. 1 is a block diagram of an LCD device that includes a reference voltage generating circuit 100, an LCD panel 11, a gate driver 12, a source driver 13, and a timing controller 14. In the LCD panel 11, a plurality of gate lines are arranged to cross a plurality of data lines. The gate driver 12 sequentially applies a driving signal to the gate lines. The source driver 13 applies a data signal to the data lines. The reference voltage generating circuit 100 applies a reference voltage to the source driver 13. The timing controller 14 applies various control signals and voltages to the gate driver 12 and the source driver 13. The source driver 13 includes a shift register 15, a latch 16, a digital-to-analog converter (DAC) 18, and an amplifier 19. The source driver 18 firstly receives input digital data without processing. Then the DAC 18, controlled by the timing controller 14, converts the digital data to analog signals that can be applied to the LCD panel 11, and outputs the resultant values to each data line. At this time, the gamma voltages obtained by voltage division through resistors are outputted from the reference voltage generating circuit 100 to the source driver 13. The gamma voltages are varied depending on the LCD module.

FIG. 2 shows a prior reference voltage generating circuit 200 for generating gamma voltages disclosed in U.S. Pat. No. 6,731,259 to Jung Taeck Yer, Sin Hi Kang and Jong Dae Kim, which is included herein by reference. The reference voltage generating circuit 200 includes two voltage strings 23 and 25 arranged in parallel between a power source voltage terminal Vdd and a ground voltage terminal Vss, and an amplifier portion 27. The respective voltage strings 23 and 25 include a plurality of resistors R1 through R6 and R7 through R12 serially connected to generate a plurality of gamma voltages V1 through V10 through voltage division by the respective resistors. A corresponding amplifier of the amplifier portion 37 amplifies the gamma voltages V1 through V10 generated by the respective voltage strings 23 and 25. If the power source voltage Vdd is input, the gamma voltages from V1 to V10 are set by serially connected resistance values. At this time, voltages of a positive frame are set as the gamma voltages from V1 to V5 while voltages of a negative frame are set as the gamma voltages from V6 to V10. The reference voltage generating circuit 200 has a simple circuit structure and can be applied to most DACs. However, the reference voltage generating circuit 200 occupies a lot of space.

FIG. 3 shows another prior reference voltage generating circuit 300 for generating gamma voltages disclosed in U.S. Patent Publication. No. 2003/0151577 to Morita, which is included herein by reference. The reference voltage generation circuit 300 includes a positive polarity ladder resistor circuit 310 and a negative polarity ladder resistor circuit 320. The positive polarity ladder resistor circuit 310 generates reference voltages V1 to Vi used at a positive polarity inversion period through voltage division by a resistor string 312, and the negative ladder resistor circuit 320 generates reference voltage V1 to Vi used in a negative polarity inversion period through voltage division by a resistor string 322. In the reference voltage generating circuit 300, the positive polarity ladder resistor circuit 310 is coupled between a first power source line and a second power source line through switches SW1 and SW2 respectively, and the negative polarity ladder resistor circuit 320 is coupled between the first power source line and the second power source line through switches SW3 and SW4 respectively. The first power source line and the second power source line are set to fixed potentials Vdd and Vss respectively. Designated as S are switches controlled by a polarity inversion circuit. Designated as R are resistors of the resistor strings 312 and 322. Designated as VND1 through VNDi are reference output nodes of the reference voltage generating circuit 300.

In an LCD, the magnitude of the applied voltage determines the intensity of light emitted by pixel cells. To prevent polarization and rapid permanent damage of the liquid crystal material, the polarity of the cell voltage is reversed on alternative intervals. Therefore, in the case of line inversion and voltages of pixel cells of the same line have the same polarity, voltages of pixel cells of adjacent lines have opposite polarities against the upper common electrode; in the case of dot inversion, voltages of adjacent pixel cells of the same line have opposite polarities. Since the liquid crystal is made of a dielectric in this instance, charging and discharging of the liquid crystal will consume power during voltage polarity alternations. In the reference voltage generating circuit 300, the first power source line and the second power source line are set to fixed potentials Vdd and Vss, and a predetermined input voltage is required to establish a potential difference required for a positive polarity inversion period and a negative polarity inversion period. Since the first power source line and the second power source line are set to fixed potentials, the predetermined input voltage can not be changed during the positive polarity inversion period and the negative polarity inversion period. Therefore the reference voltage generating circuit 300 is quite power-consuming.

SUMMARY OF INVENTION

It is an objective of the claimed invention to provide a reference voltage generation circuit in order to solve the problems of the prior art.

The claimed invention discloses a reference voltage generation circuit for generating gamma voltages including a first voltage source, a second voltage source, a variable voltage source, a first resistor circuit, a second resistor circuit, a plurality of first switches, and a polarity inversion circuit. The first resistor circuit is formed by a plurality of first resistors coupled in series, with a first end of the first resistor circuit coupled to the first voltage source and a second end of the first resistor circuit coupled to the variable voltage source. The second resistor circuit is formed by a plurality of second resistors coupled in series, with a first end of the second resistor circuit coupled to the second voltage source and a second end of the second resistor circuit coupled to the variable voltage source. Each of the first switches has a first end coupled between two of the first resistors and a second end coupled to a digital-to-analog converter. Each of the second switches has a first end coupled between two of the second resistors and a second end coupled to the digital-to-analog converter. The polarity inversion circuit controls the first switches and the second switches.

The claimed invention discloses a switching circuit of a digital-to-analog converter for generating gamma voltages including a first resistor circuit, a second resistor circuit, a plurality of first switches and a plurality of second switches. The first resistor circuit is coupled to a reference voltage generation unit and is formed by a plurality of first resistors coupled in series. The second resistor circuit is coupled to the reference voltage generation unit and is formed by a plurality of second resistors coupled in series. Each of the first switches has a first end coupled between two of the first resistors and a second end coupled to a digital-to-analog converter internal circuit. Each of the second switches has a first end coupled between two of the second resistors a second end coupled to the digital-to-analog converter internal circuit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
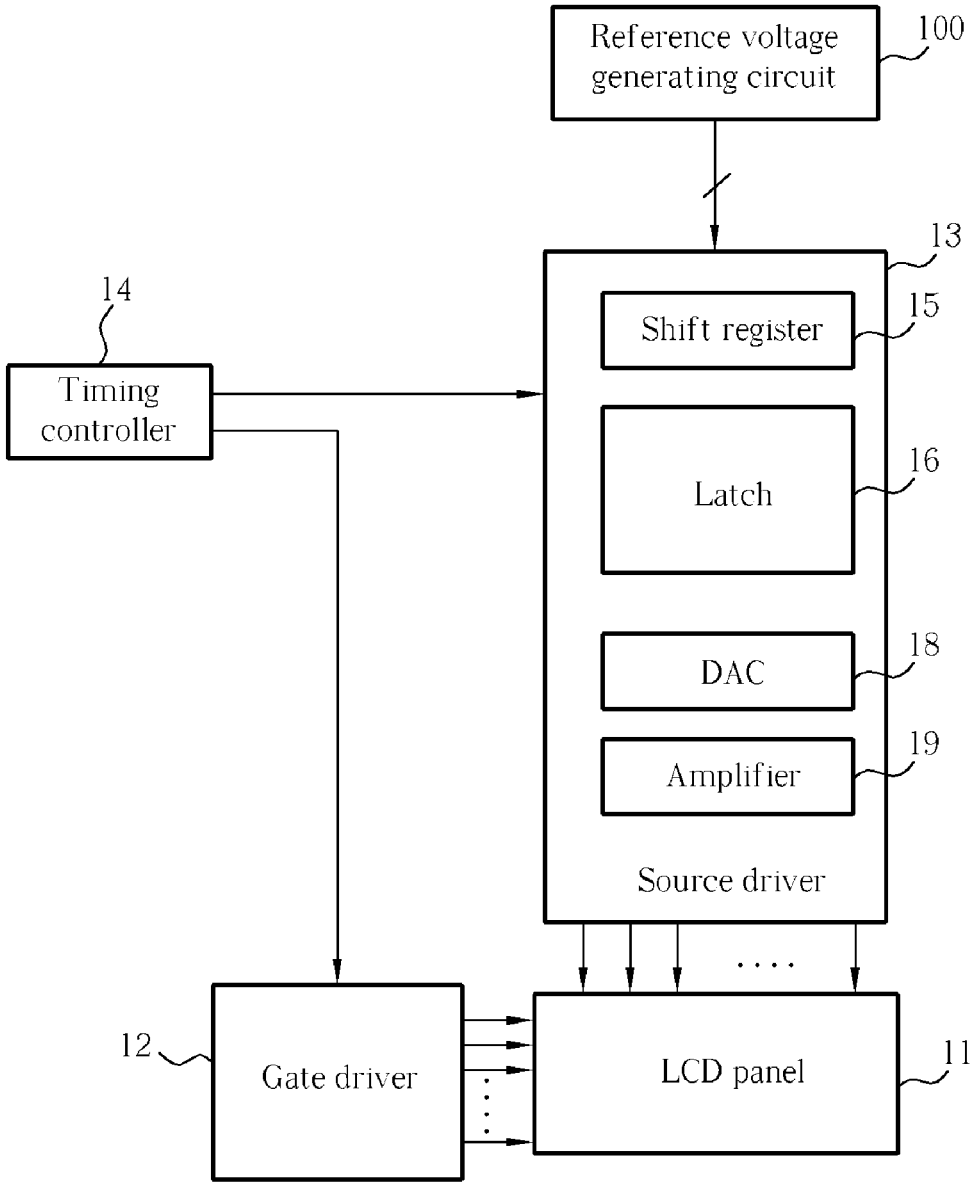
Fig. 1 Prior Art
FIG. 1 is a block diagram of a prior art liquid crystal display.
Figure 2:
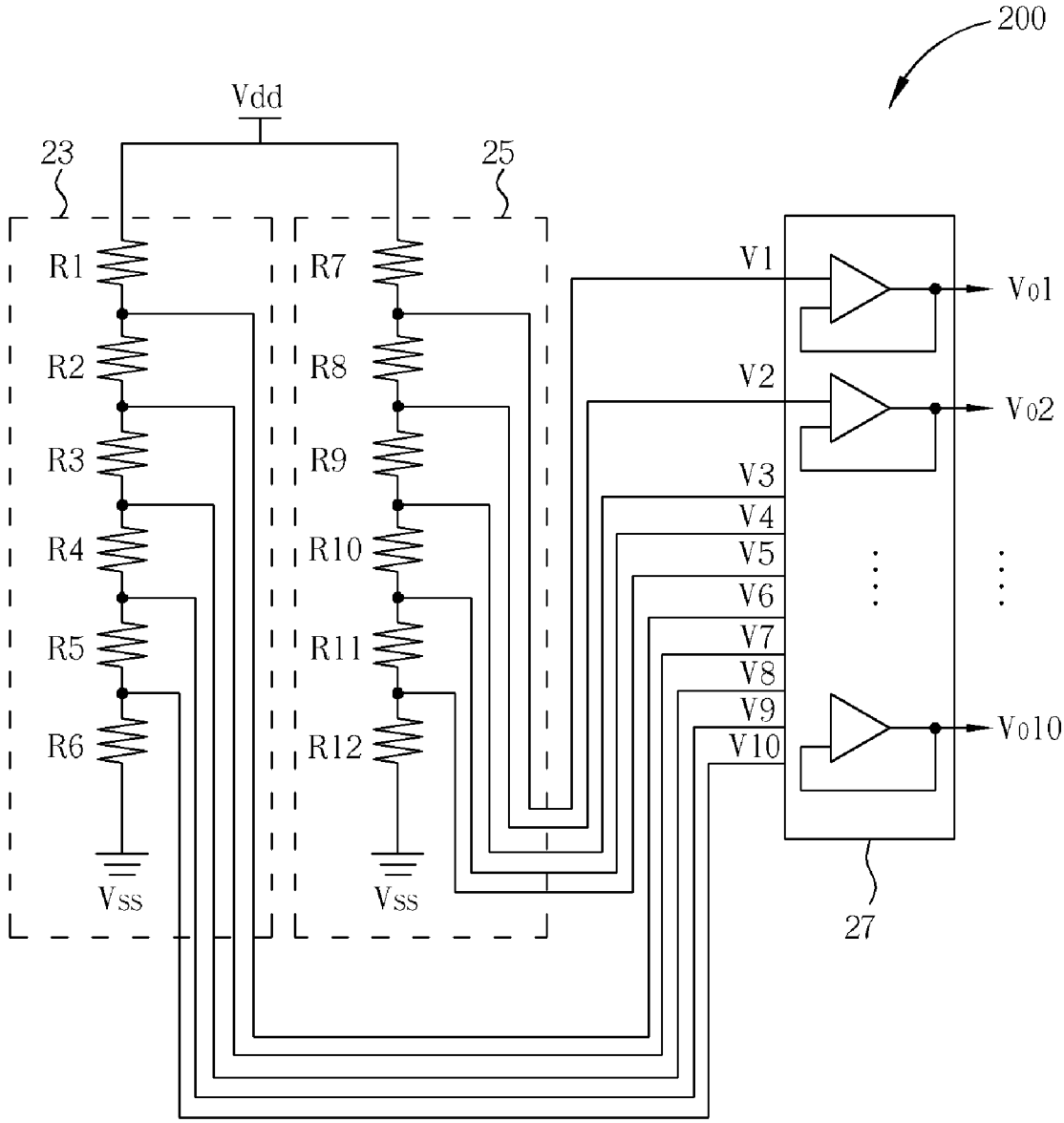
Fig. 2 Prior Art
FIG. 2 is circuit diagram of a reference voltage generating circuit of the liquid crystal display in FIG. 1.
Figure 3:
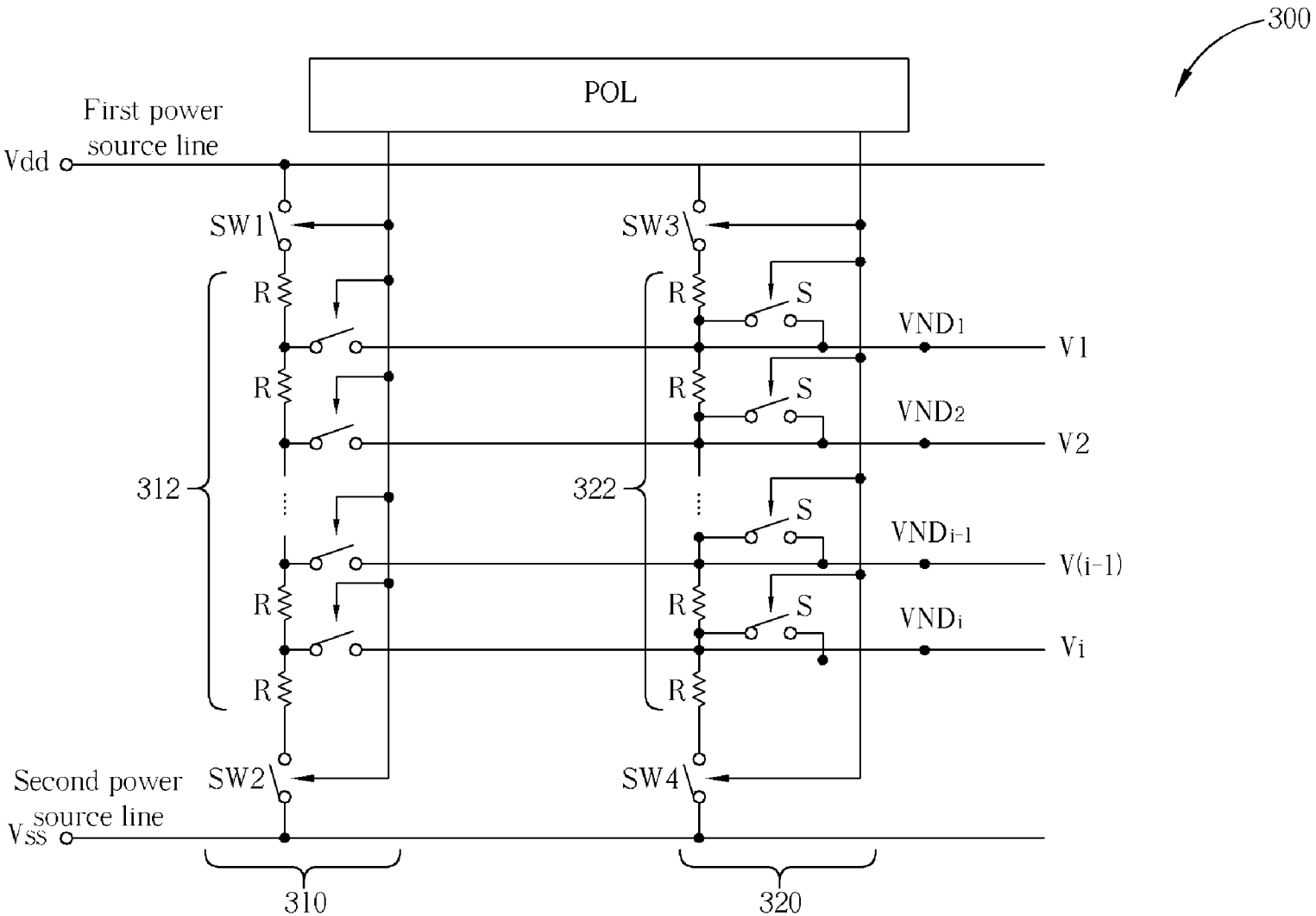
Fig. 3 Prior Art
FIG. 3 is circuit diagram of another prior art reference voltage generating circuit.
Figure 4:
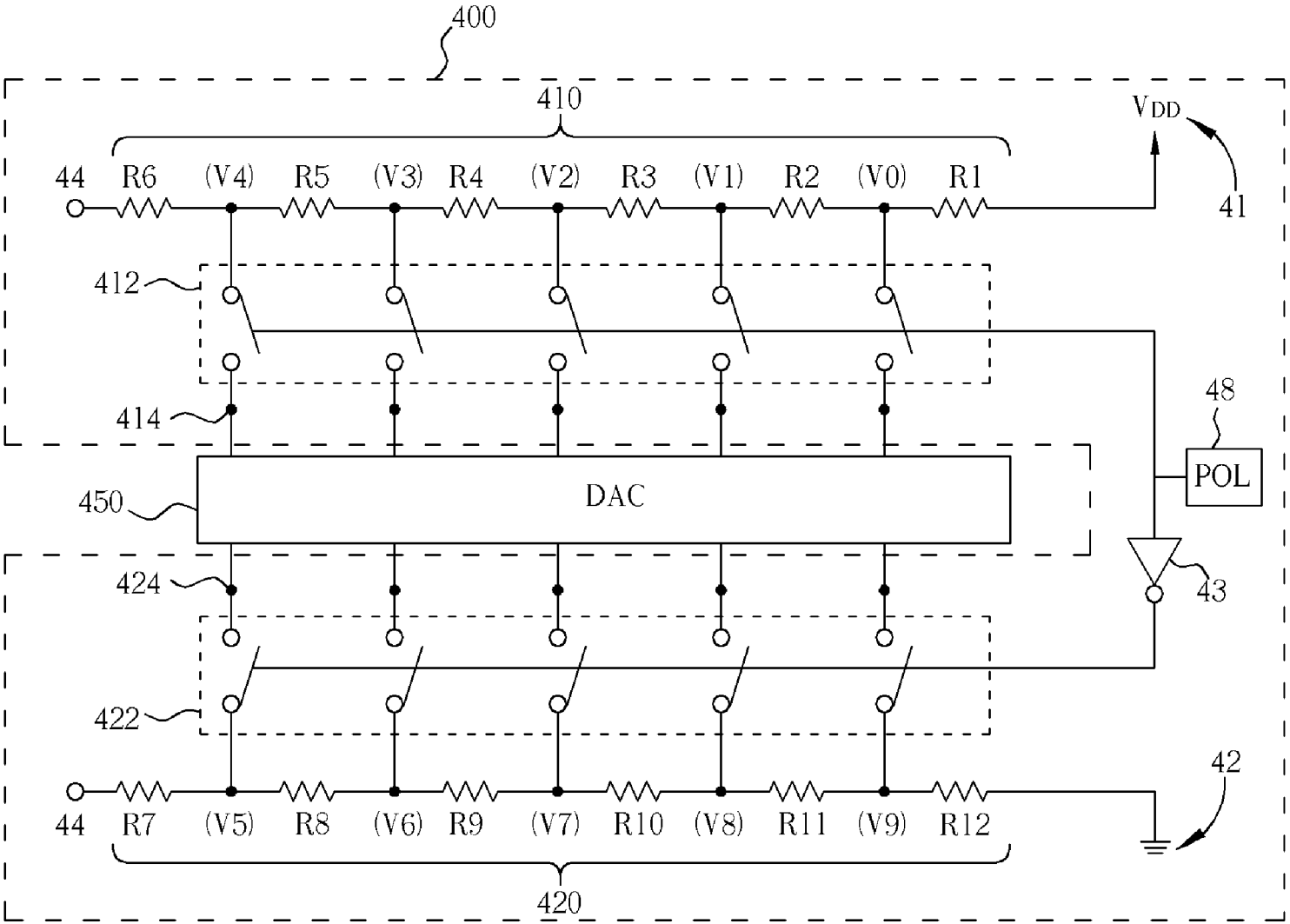
FIG. 4 is circuit diagram of a first embodiment of the present invention reference voltage generating circuit.

Please refer to FIG. 4 for a reference voltage generation circuit 400 for generating gamma voltages according to the present invention. The reference voltage generation circuit 400 is coupled to a digital-to-analog converter (DAC) 450 and includes a first voltage source 41, a second voltage source 42, a variable voltage source 44, a first resistor circuit 410, a second resistor circuit 420, a plurality of first switches 412, a plurality of second switches 422 and a polarity inversion circuit (POL) 48. The first resistor circuit 410 is formed by a plurality of first resistors coupled in series, with a first end coupled to the first voltage source 41 and a second end coupled to the variable voltage source 44. The second resistor circuit 420 is formed of a plurality of second resistors coupled in series, with a first end coupled to the second voltage source 42 and a second end coupled to the variable voltage source 44. Each of the first switches 412 has a first end coupled between two of the first resistors and a second end coupled to a plurality of first reference output voltage nodes 414, and each of the second switches 422 has a first end coupled between two of the second resistors and a second end coupled to a plurality of second reference output voltage nodes 424. The polarity inversion circuit 48 controls the on and off of the first switches and the second switches. The gamma reference voltages obtained at the first reference output voltage nodes 414 by voltage division through the first resistors are outputted from the reference voltage generation circuit 400 to the DAC 450 during a first polarity inversion period; similarly, the gamma reference voltages obtained at the second reference output voltage nodes 424 by voltage division through the second resistors are outputted from the reference voltage generation circuit 400 to the DAC 450 during a second polarity inversion period.

In the embodiment of the present invention shown in FIG. 4, the first voltage 41 is set to a positive potential VDD, the second voltage 42 is set to ground (VSS), and the variable voltage source 44 can be set to a fixed value such as ½ VDD, or can be varied between VDD and VSS. The first resistor circuit 410 includes 6 resistors R1 through R6 and provides 5 reference voltages V0 through V4 at each of division nodes provided between two adjacent resistors. Similarly, the negative resistor circuit 420 includes 6 resistors R7 through R12 and provides 5 reference voltages V5 through V9 at each of division nodes provided between two adjacent resistors. The polarity inversion circuit 48 sends a polarity control signal directly to the first switches 412 and to the second switches 422 through an inverter 43. When the logical level of the polarity inversion signal is high, the first switches 412 are turned on and the reference voltage generation circuit 400 provides positive reference voltages V0 through V4 to the DAC 450. Similarly, when the logical level of the polarity inversion signal is low, the second switches 422 are turned on and the reference voltage generation circuit 400 provides negative reference voltages V5 through V9 to the DAC 450.

When the variable voltage source 44 is not fixed to ½ VDD, the voltage of the variable voltage source 44 can be set to a first value during the positive polarity inversion period and to a second value during the negative polarity inversion period to save power. For example, if a potential difference of 5V is required between the variable voltage source 44 and an input voltage, and the variable voltage source 44 can be modulated between 0V and 6V. Then, during the positive polarity inversion period, the required voltage difference of 5V can be achieved by setting the variable voltage source 44 to 0V and setting the input voltage to 5V. During the negative polarity period, the required voltage difference of −5V can be achieved by setting the variable voltage source 44 to 6V and an input voltage to 1V. Moreover during the negative polarity period, the required voltage difference of −5V can be achieved by setting the variable voltage source 44 to 5V and an input voltage to 0V to further save power. Since during the negative polarity inversion period, the input voltage is much lower than 5V, power consumption is greatly reduced. Compared to the prior art reference voltage generating circuits 200, 300, the present invention reference voltage generation circuit 400 occupies less circuit space, consumes less power and is particularly suitable for applications on liquid crystal displays that utilize line-inversion or frame-inversion techniques.

Figure 5:
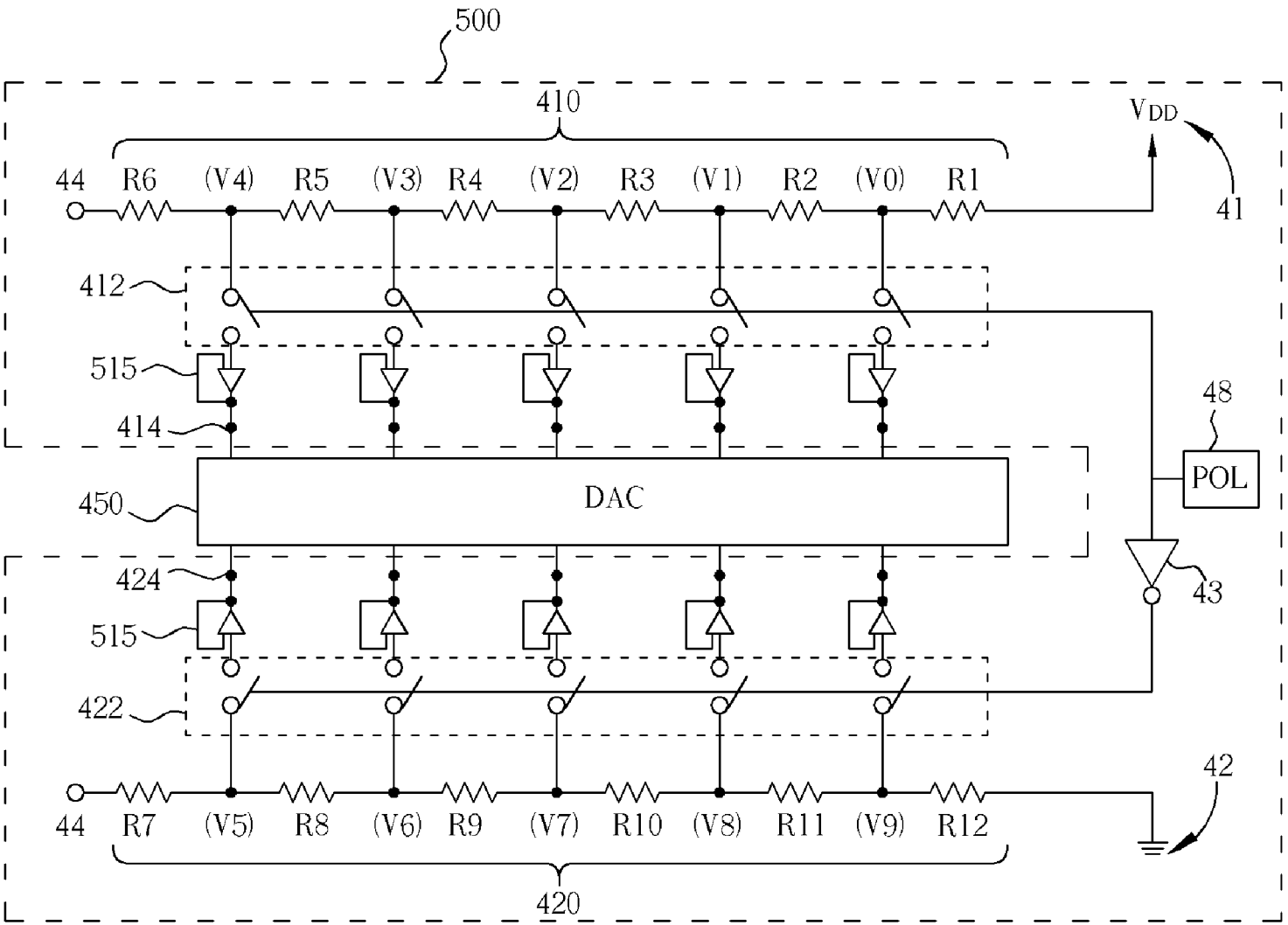
FIG. 5 is circuit diagram of a second embodiment of the present invention reference voltage generating circuit.

FIG. 5 shows a second embodiment of a reference voltage generation circuit 500 for generating gamma voltages according to the present invention. The reference voltage generation circuit 500 differs from the reference voltage generation circuit 400 in that the reference voltage generation circuit 500 further includes a plurality of first output buffers 515 and a plurality of second output buffers 525. Each of the first output buffers 515 is coupled between the second end of a corresponding first switch 412 and the corresponding first reference output voltage nodes 414; similarly, each of second output buffers 525 is coupled between the second end of a corresponding second switch 422 and the corresponding second reference output voltage nodes 424. The first output buffers 515 and the second output buffers 525 amplify voltages to be outputted at the reference output voltage nodes 414 and 424, and can further increase the driving capability of the reference voltage generation circuit 500.

Figure 6:
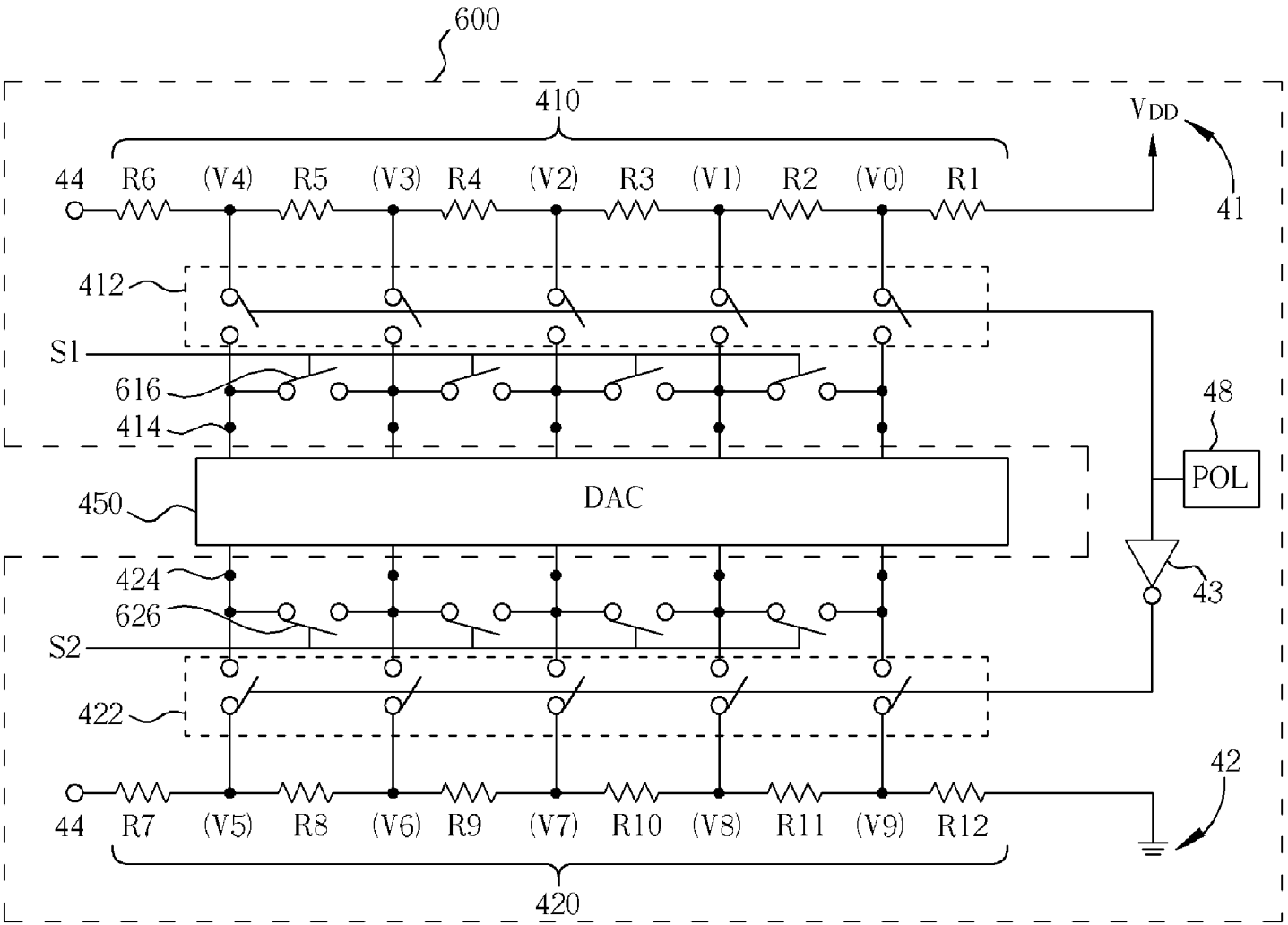
FIG. 6 is circuit diagram of a third embodiment of the present invention reference voltage generating circuit.

FIG. 6 shows a third embodiment of a reference voltage generation circuit 600 for generating gamma voltages according to the present invention. The reference voltage generation circuit 600 differs from the reference voltage generation circuit 400 in that the reference voltage generation circuit 600 further includes a plurality of first charge-sharing switches 616 and a plurality of second charge-sharing switches 626, controlled by signals S1 and S2 respectively. Each of the first charge-sharing switches 616 is coupled between two corresponding first switches 412, and each of the second charge-sharing switches 626 is coupled between two corresponding second switches 422. The charge-sharing switches 616 and 626 can further reduce power consumption of the reference voltage generation circuit 600. The signal S1 controls charge-sharing switches 616 to perform charge-sharing operation for a pre-determined period before polarity switch from positive to negative, and the signal S2 controls charge-sharing switches 626 to perform charge-sharing operation for a pre-determined period before polarity switch from negative to positive. The power consumption of a reference voltage generating circuit is proportional to the square of the sum of the voltage differences between each positive gamma voltage and its corresponding negative gamma voltage. Suppose the reference voltage generation circuit 600 is designed to provide gamma reference voltages V0 through V9 with values 10V, 9V, 8V, . . . , 1V respectively, the power consumption without charge sharing is proportional to:

$$\Delta E_{without} \propto [(10-1)^2+(9-2)^2+(8-3)^2+(7-4)^2+(6-5)^2] = 165$$

However with charge sharing, the average positive gamma voltage Vp, the average negative gamma voltage Vn and the resultant power consumption are:

$$Vp=(10+9+8+7+6)/5=8$$

$$Vn=(5+4+3+2+1)/5=3$$

$$\Delta E_{with} \propto (8-3)^2=25$$

Therefore the reference voltage generation circuit 600 with the charge-sharing switches 616 and 626 can significantly reduce the power consumption of the reference voltage generation circuit 600.

Figure 7:
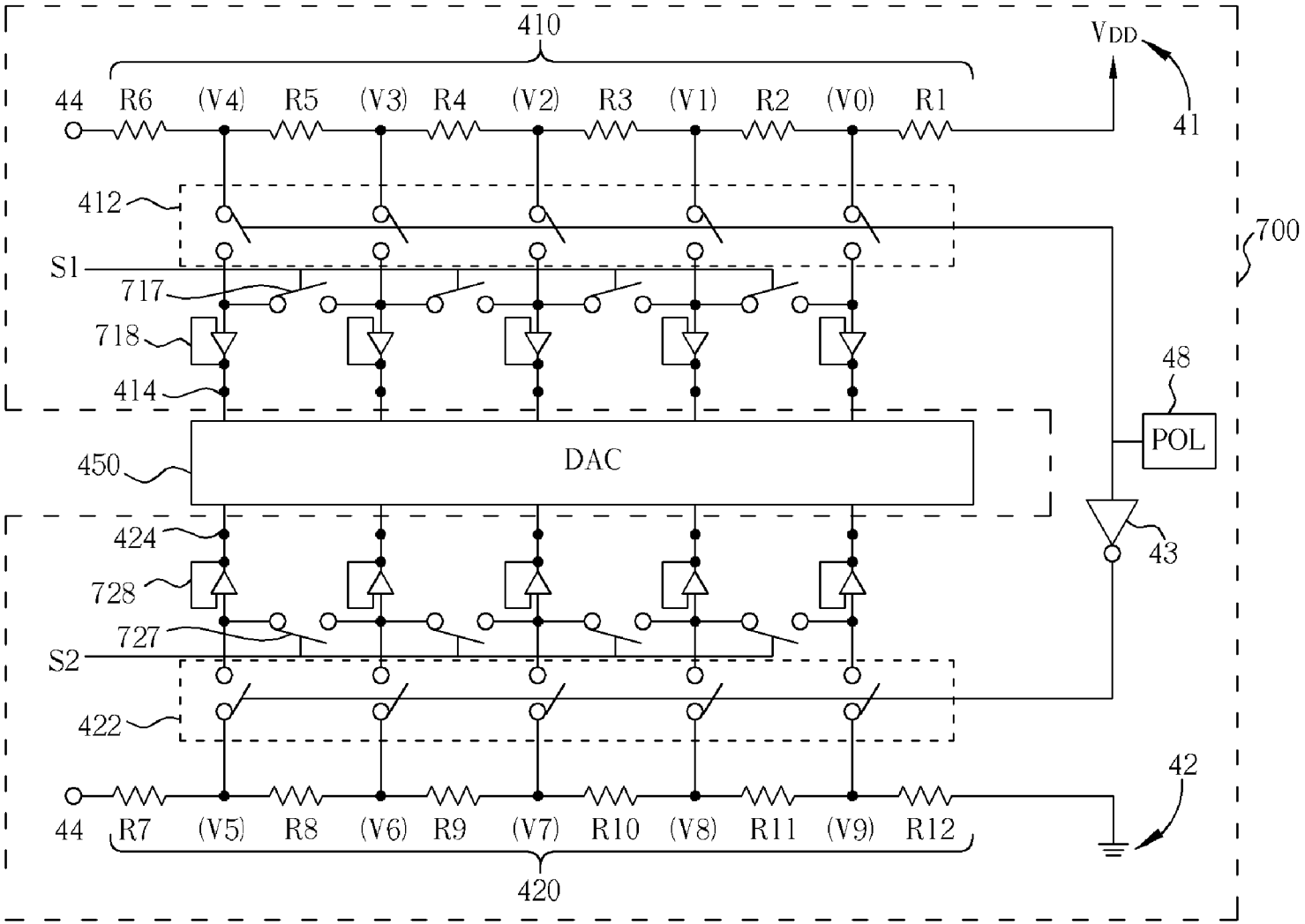
FIG. 7 is circuit diagram of a fourth embodiment of the present invention reference voltage generating circuit.

FIG. 7 shows a fourth embodiment of a reference voltage generation circuit 700 for generating gamma voltages according to the present invention. The reference voltage generation circuit 700 differs from the reference voltage generation circuit 400 in that the reference voltage generation circuit 700 includes both the output buffers and the charge-sharing switches described in FIG. 5 and FIG. 6. Each of the first charge-sharing switches 717 is coupled between two corresponding first switches 412, and each of the second charge-sharing switches 727 is coupled between two corresponding second switches 422. Each of the first output buffers 718 is coupled between an end of a corresponding charge-sharing switch 717 and the corresponding first reference output voltage node 414; similarly, each of second output buffers 728 is coupled between an end of the second charge-sharing switch 727 and the corresponding second reference output voltage node 424. Signals S1 and S2 control the charge-sharing switches 717 and a 727 respectively.

Figure 8:
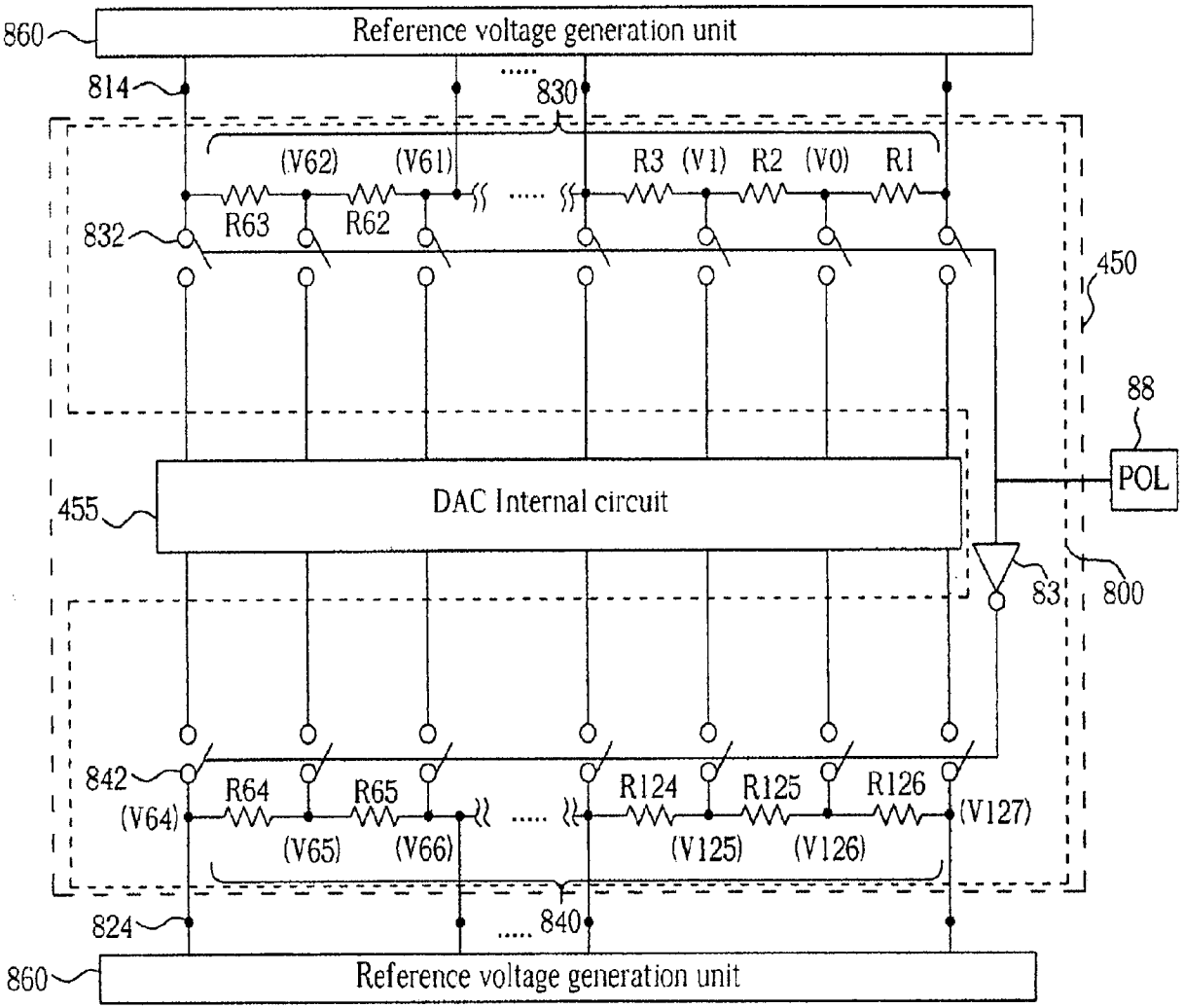
FIG. 8 is circuit diagram of a fifth embodiment of the present invention reference voltage generating circuit.

FIG. 8 shows a fifth embodiment of a reference voltage generation circuit 800 for generating gamma voltages according to the present invention. The reference voltage generation circuit 800 is coupled between a DAC internal circuit 455, such as a decoder, and a reference voltage generation unit 860. The reference voltage generation unit 860 provides positive reference voltages at a plurality of first reference output voltage nodes 814 and provides negative reference voltages at a plurality of second reference output voltage nodes 824. Each of the reference voltage generation circuits 400, 500, 600 and 700 described in FIG. 4 through FIG. 7 as well as other prior art reference voltage generation circuits can be adopted for the reference voltage generation unit 860.

The reference voltage generation circuit 800 includes a third resistor circuit 830, a fourth resistor circuit 840, a plurality of third switches 832, a plurality of fourth switches 842 and a polarity inversion circuit 88. The resistor circuits 830 and 840 of the reference voltage generation circuit 800 are formed by a plurality of third resistors R1~R63 and a plurality of fourth resistors R64~R127 coupled in series, respectively. The polarity inversion circuit 88 sends a polarity control signal directly to the third switches 832 and to the fourth switches 842 through an inverter 83. By voltage division through the third resistors and the fourth resistors, the voltages obtained at the first reference output voltage nodes 814 and the second reference output voltage nodes 824 from the reference voltage generation unit 860 can be further divided for providing the DAC internal circuit 455 with the required gamma voltages. In the reference voltage generation circuit 800, voltage division is performed by resistors R1~R63 of the third resistor circuit 830 between reference voltages obtained from first reference output voltage nodes 814. The DAC internal circuit 455 obtains required gamma voltages through third switches 832 during a positive polarity inversion period. Similarly, voltage division is performed by resistors R64~R127 of the fourth resistor circuit 840 between reference voltages obtained from second reference output voltage nodes 824. The DAC internal circuit 455 obtains required gamma voltages through fourth switches 842 during a negative polarity inversion period. Accordingly, the DAC 450 can get a plurality of gamma voltages. The number and the values of the resistor circuits 830 and 840 are based on the number and the values of gamma voltages required by the DAC 450, and can be varied accordingly.

Figure 9:
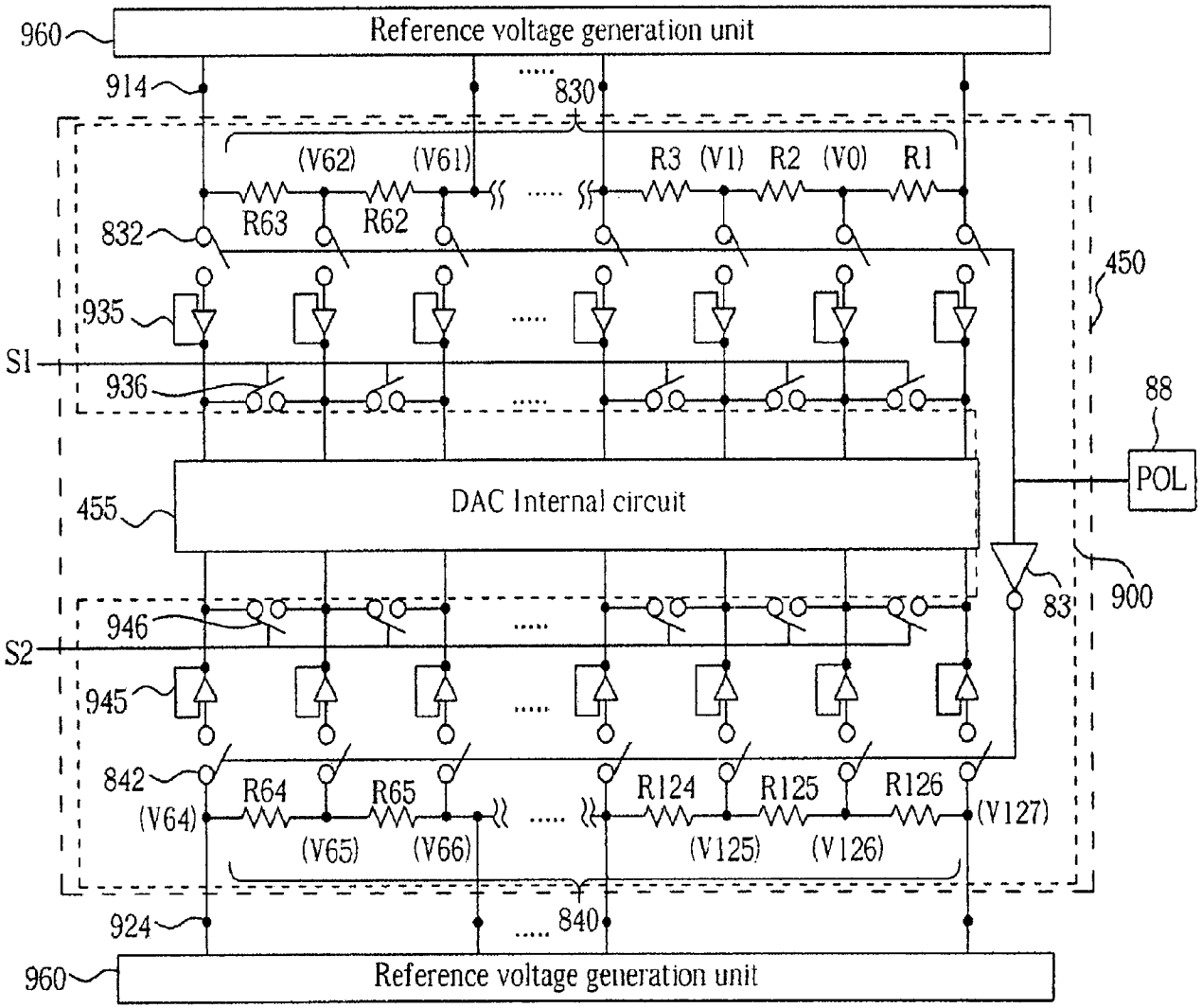
FIG. 9 is circuit diagram of a sixth embodiment of the present invention reference voltage generating circuit.

FIG. 9 shows a sixth embodiment of a reference voltage generation circuit 900 for generating gamma voltages according to the present invention. The reference voltage generation circuit 900 is coupled to the DAC internal circuit 455 and a reference voltage generation unit 960. The reference voltage generation unit 960 provides positive reference voltages at a plurality of first reference output voltage nodes 914 and negative reference voltages at a plurality of second reference output voltage nodes 924. Each of the reference voltage generation circuits 400, 500, 600 and 700 described in FIG. 4 through FIG. 7 as well as other prior art reference voltage generation circuits can be adopted for the reference voltage generation unit 960. The reference voltage generation circuit 900, with similar structure as the reference voltage generation circuit 800, further includes a plurality of third output buffers 935, a plurality of fourth output buffers 945, a plurality of third charge-sharing switches 936 and a plurality of fourth charge-sharing switches 946. The output buffers 935 and 945 can improve the driving capability of the reference voltage generation circuit 900. The charge-sharing switches 936 and 946 controlled by signals S1 and S2 respectively can reduce power consumption of the reference voltage generation circuit 900. The signal S1 controls charge-sharing switches 936 to perform charge-sharing operation for a pre-determined period before polarity switch from positive to negative, and the signal S2 controls charge-sharing switches 946 to perform charge-sharing operation for a pre-determined period before polarity switch from negative to positive.

Compared to the prior art reference voltage generating circuits, the present invention provides reference voltage generation circuits that have simple structures and occupy less circuit space. The present invention reference voltage generation circuits reduce power consumption by modulating the value of the variable voltage source during the positive and negative polarity inversion periods, or by including the charge-sharing switches. The present invention reference voltage generation circuits can also include output buffers that further improve the driving capability of the reference voltage generation circuit. In conclusion, the present invention provides a reference voltage generating circuit that occupies less circuit space, consumes less power and is particularly suitable for applications on displays that utilize line-inversion or frame-inversion techniques.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A reference voltage generation circuit for generating gamma voltages, the reference voltage generating circuit comprising:

a first voltage source;

a second voltage source;

a variable voltage source, wherein the voltage of the variable voltage source is not fixed, and is modulated between a first voltage value and a second voltage value during positive and negative inversion periods, and the first and second voltage values are between voltage potentials of the first and second voltage sources;

a first resistor circuit formed by a plurality of first resistors coupled in series, a first end of the first resistor circuit coupled to the first voltage source and a second end of the first resistor circuit coupled to the variable voltage source;

a plurality of first switches each having a first end coupled between two of the first resistors and a second end coupled to a digital-to-analog converter;

a plurality of first charge-sharing switches each coupled to a second end of a corresponding first switch;

a second resistor circuit formed of a plurality of second resistors coupled in series, a first end of the second resistor circuit coupled to the second voltage source and a second end of the second resistor circuit coupled to the variable voltage source;

a plurality of second switches each having a first end coupled between two of the second resistors and a second end coupled to the digital-to-analog converter;

a plurality of second charge-sharing switches each coupled to a second end of a corresponding second switch; and a polarity inversion circuit for controlling the first switches and the second switches.

2. The reference voltage generation circuit of claim 1 further comprising an inverter coupled to the polarity inversion circuit for inverting control signals generated by the polarity inversion circuit for controlling on and off of the second switches.

3. The reference voltage generation circuit of claim 1 further comprising a plurality of first output buffers each coupled to a second end of a corresponding first switch, and a plurality of second output buffers each coupled to a second end of a corresponding second switch.

4. The reference voltage generation circuit of claim 1 wherein the first voltage source has a positive voltage potential.

5. The reference voltage generation circuit of claim 1 wherein the second voltage source is ground.

6. The reference voltage generation circuit of claim 1 wherein an initial voltage of the variable voltage source equals to an average of the first voltage source and the second voltage source.

7. The reference voltage generation circuit of claim 1 wherein the digital-to-analog converter comprises:

a third resistor circuit coupled to the first switches, the third resistor circuit being formed by a plurality of third resistors coupled in series;

a plurality of third switches each having a first end coupled between two of the third resistors; and a fourth resistor circuit coupled to the second switches, the third resistor circuit being formed by a plurality of fourth resistors coupled in series; and a plurality of fourth switches each having a first end coupled between two of the fourth resistors.

8. The reference voltage generation circuit of claim 7 further comprising a plurality of third output buffers each coupled to a second end of a corresponding third switch, and a plurality of fourth output buffers each coupled to a second end of a corresponding fourth switch.

9. The reference voltage generation circuit of claim 7 further comprising a plurality of third charge-sharing switches each coupled to a second end of a corresponding third switch, and a plurality of fourth charge-sharing switches each coupled to a second end of a corresponding fourth switch.

10. The reference voltage generation circuit of claim 7 having all devices disposed on a same integrated circuit board.

11. A switching circuit of a digital-to-analog converter for generating gamma voltages, the switching circuit comprising:

a reference generation unit comprising:

a first voltage source;

a second voltage source;

a variable voltage source, wherein the voltage of the variable voltage source is not fixed, and is modulated between a first voltage value and a second voltage value during positive and negative inversion periods, and the first and second voltage values are between voltage potentials of the first and second voltage sources;

a first resistor circuit formed by a plurality of first resistors coupled in series, a first end of the first resistor circuit coupled to the first voltage source and a second end of the first resistor circuit coupled to the variable voltage source;

a plurality of first switches each having a first end coupled between two of the first resistors and a second end coupled to the digital-to-analog converter;

a plurality of first charge-sharing switches each coupled to a second end of a corresponding first switch;

a second resistor circuit formed by a plurality of second resistors coupled in series, a first end of the second resistor circuit coupled to the second voltage source and a second end of the second resistor circuit coupled to the variable voltage source;

a plurality of second switches each having a first end coupled between two of the second resistors and a second end coupled to the is digital-to-analog converter;

a plurality of second charge-sharing switches each coupled to a second end of a corresponding second switch; and a polarity inversion circuit for controlling the first switches and the digital-to-analog converter switches;

a third resistor circuit coupled to the reference voltage generation unit, the third resistor circuit being formed by a plurality of third resistors coupled in series;

a plurality of third switches each having a first end coupled between two of the third resistors and a second end coupled to a digital-to-analog converter internal circuit;

a fourth resistor circuit coupled to the reference voltage generation unit, the fourth resistor circuit being formed by a plurality of fourth resistors coupled in series; and a plurality of fourth switches each having a first end coupled between two of the fourth resistors a second end coupled to the digital-to-analog converter internal circuit.

12. The switching circuit of claim 11 further comprising a plurality of first output buffers each coupled between a second end of a corresponding first switch, and a plurality of second output buffers each coupled between a second end of a corresponding second switch.

13. The switching circuit of claim 11 further comprising an inverter coupled to the polarity inversion circuit for inverting control signals generated by the polarity inversion circuit for controlling on and off of the fourth switches.

14. The switching circuit of claim 11 further comprising a plurality of third output buffers each coupled to a second end of a corresponding third switch, and a plurality of fourth output buffers each coupled to a second end of a corresponding fourth switch.

15. The switching circuit of claim 11 further comprising a plurality of third charge-sharing switches each coupled to a second end of a corresponding third switch, and a plurality of fourth charge-sharing switches each coupled to a second end of a corresponding fourth switch.

16. The switching circuit of claim 11 wherein the first voltage source has a positive voltage potential.

17. The switching circuit of claim 11 wherein the second voltage source is ground.

18. The switching circuit of claim 11 wherein an initial voltage of the variable voltage source equals to an average of the first voltage source and the second voltage source.

19. The switching circuit of claim 11 having all devices disposed on a same integrated circuit board.

* * * * *